US006126010A

United States Patent [19]

Kogen

[11] Patent Number: 6,126,010

[45] Date of Patent: Oct. 3, 2000

[54] COLLAPSIBLE CUP AND PILL ORGANIZER UNIT

[75] Inventor: Robert A. Kogen, Elkins Park, Pa.

[73] Assignee: L. Lawrence Products, Inc., Huntingdon Valley, Pa.

[21] Appl. No.: 09/396,670

[22] Filed: Sep. 15, 1999

[51] Int. Cl.[7] ..... B65D 71/00; B65D 77/22; B65D 83/04

[52] U.S. Cl. ..... 206/570; 206/218; 206/538

[58] Field of Search ..... 206/218, 538, 206/539, 570

[56] References Cited

U.S. PATENT DOCUMENTS

| | | | |
|---|---|---|---|
| 1,817,562 | 8/1931 | Hodge | 206/538 |
| 3,285,459 | 11/1966 | Gahm | 206/218 X |
| 3,434,589 | 3/1969 | Valtin et al. | 206/218 |
| 4,053,054 | 10/1977 | Lucas | 206/538 X |
| 4,261,468 | 4/1981 | Krebs | 206/538 |
| 4,572,376 | 2/1986 | Wrennall . | |
| 4,940,138 | 7/1990 | Hornstein | 206/218 |
| 5,322,166 | 6/1994 | Crowther . | |
| 5,762,199 | 6/1998 | Aguilera | 206/538 |

OTHER PUBLICATIONS

Photograph of Jewelry Cleaner Device of Lockhert Jewelry Co., Inc. of Downingtown PA Under the Trademark POWERVESCENT® Jewelry Cleaner.

*Primary Examiner*—Bryon P. Gehman

*Attorney, Agent, or Firm*—Caesar, Rivise, Bernstein, Cohen & Pokotilow, Ltd.

[57] ABSTRACT

A combination pill dispenser and collapsible drinking cup unit. The unit includes an elongated hollow body, a first removable cap member, a second removable cap member, a pill organizer, and a collapsible cup. The hollow body has an outer wall including opposed first and second ends and an end wall located adjacent the first forming a hollow chamber in which the pill organizer is located. A first removable cap is provided to close the chamber in which the organizer is located. The organizer includes a plurality of wedge-shaped compartments formed by plural wall panels radiating outward from a central post. The post projects upward from a circular, planar base member. A circular, planar cover is rotatably mounted on the post and includes a wedge shaped opening in its periphery. The opening is arranged to selectively communicate with a respective one of the compartments when the cover is rotated to a desired orientation. The second cap member has an end wall and a peripheral flange, and is arranged for releasable securement to the first end of the hollow body. The collapsible cup is located on the end wall of the second cap member and within the bounds of the peripheral flange. The collapsible cup is formed of plural conical shaped sections which are nested together and arranged to be moved from the nested position to an extended position to form a leak-proof cup.

10 Claims, 3 Drawing Sheets

COLLAPSIBLE CUP AND PILL ORGANIZER UNIT

BACKGROUND OF THE INVENTION

This invention relates generally to containers and more particularly to a pill organizer with a collapsible drinking cup in the form of an integral, readily stowable unit.

Various pill organizers or dispensers have been disclosed in the patent literature and/or are commercially available. For example, In U.S. Pat. No. 4,572,376 (Wrennall) there is disclosed a dial pill box comprises a container having 28 arcuate storage compartments for pills and the like, a pair of lids, and a central pivot pin which pivotably holds together the container and the lids. The pivot pin enables the containers to be assembled by snapping the lids onto the container and over the pivot pin and to be disassembled by pinching together the resiliently bifurcated ends of the pivot pin and pushing these ends toward the lids and through their central holes. After removing both lids, a user can fill the container with a week's supply of pills, capsules, tablets, and the like of pharmaceuticals, vitamins, and/or minerals. The user can spin the upper lid independently of the lower lid in one direction, so that none of the four segment apertures in the upper lid coincide with the access sector of the lower lid, whereby the dial pill box is in position for storage and transportation. By spinning both lids together in the opposite direction, the user can place the access sector in the lower lid over a selected storage sector, having four storage compartments, which is marked for the desired day of the week. By then spinning the upper lid again in the first direction, the user can spirally place a selected segment aperture, corresponding to the selected time of day, over the access sector and then remove the pills therefrom.

In U.S. Pat. No. 5,762,199 (Aguilera) there is disclosed a daily pocket pill organizer. That organizer is in the form of a compartmented cylindrical container having a removable snap-on cap and plural pie-shaped pill-receiving compartments. The cap is two-piece member, with each piece having a top and a bottom side. One of the two pieces is a rotatable "covering" disc having a small triangular opening and a pin protruding downward from a central position on its bottom side. The second cap piece is a wheel-like member disposed under the covering member and having spokes radiating outwardly from an apertured center. The spokes form triangular or pie-shaped openings therebetween. The pin of the covering member extends through a central opening in the underlying wheel-like member so that the rotatable disc can be rotated to any angular orientation to bring its triangular shaped opening over a respective one of the openings in the spoke-like member. The openings provide fixed access to plural pie-shaped compartments of the container. The two-piece cap is removable and can be opened at one side by release of a hinge.

In U.S. Pat. No. 5,322,166 (Crowther) there is disclosed a pill storage and dispensing container has a lower storage unit with a plurality of radially arranged individual pill storage compartments. An upper storage unit positioned directly above and nestled within the lower unit also has a plurality of similarly arranged storage compartments as well as one bottomless compartment. A top cover is positioned directly above the upper storage unit, and a dispensing opening in the cover is arranged to communicate with the various compartments in the upper unit as well as with the bottomless compartment and the various compartments of the lower storage unit as the cover is rotated relative to the storage units. A hub shaft releasably interconnects the upper and lower storage units and the top cover while allowing the storage units and cover to rotate relative to on another. Twenty eight individual storage compartments are provided in a compact container which enables pills to be dispensed four times per day over a seven day period.

While all of the aforementioned devices are generally suitable for their intended purposes, each suffers from one or more of the following disadvantages, complexity of construction, expense, and ease of use. Moreover, all of the aforementioned prior art devices will require the user to provide a cup, glass or other source of water or other liquid to enable the person to take the pill(s) held in the container.

In U.S. Pat. No. 4,940,138 (Hornstein) there is disclosed a container for particular use as a first aid kit. The container comprises a tubular member which has a collapsible drinking cup forming one end closure of the container. In particular, a collapsible drinking cup has a base with a circular rim to which a plurality of annular cup segments of graduated diameter are connected. These segments may be moved with respect to one another to an extended position to form a hollow cup extending upward from the base. A cover or lid having an annular flange is arranged to be mounted on the container to enclose the collapsed cup. The cover includes an annular wall centered on its inner surface to form a pill container. Pills are retained in the container by a removable cap releasably mounted thereon.

While the device of the Hornstein patent may be generally suitable for its intended purposes, it still leaves much to be desired from the standpoints of functionality and ease of use.

OBJECTS OF THE INVENTION

Accordingly, it is a general object of this invention to provide a pill organizer which overcomes the disadvantages of the prior art.

It is a further object of this invention to provide a pill organizer having an integral collapsible drinking cup.

It is yet a further object of this invention to provide a combination pill organizer and collapsible drinking cup which is simple in construction. easy to use.

It is yet a further object of this invention to provide a combination pill organizer and collapsible drinking cup which is low in cost.

It is yet a further object of this invention to provide a combination pill organizer and collapsible drinking cup which is easy to use.

It is yet a further object of this invention to provide a combination pill organizer and collapsible drinking cup which can be collapsed into a small configuration making it suitable for easy transportation and stowage.

SUMMARY OF THE INVENTION

These and other objects of the instant invention are achieved by providing a combination pill dispenser and collapsible drinking cup device. The device basically comprises an elongated hollow body, a first removable cap member, a second removable cap member, a pill organizer, and a collapsible cup.

The hollow body has an outer wall including opposed first and second ends and an end wall located adjacent the first end. The end wall and a portion of the hollow body contiguous with the second end form a hollow chamber. The pill organizer is located within the chamber and comprises a plurality of compartments. The pill organizer includes a cover having an opening therein which is arranged to selectively communicate with a respective one of the compartments. The first cap member of the device is arranged for releasable securement to the hollow body to enclose the chamber.

The second cap member has an end wall and a peripheral flange, and is arranged for releasable securement to the first end of the hollow body. The collapsible cup is located on the end wall of the second cap member and within the bounds of the peripheral flange. The collapsible cup is arranged to be extended from a retracted position wherein it is located close to the end wall of the second cap member to an extended position wherein it is located further from the end wall of the second cap member.

DETAILED DESCRIPTION OF THE PREFERRED EMBODIMENT

Figure 1:
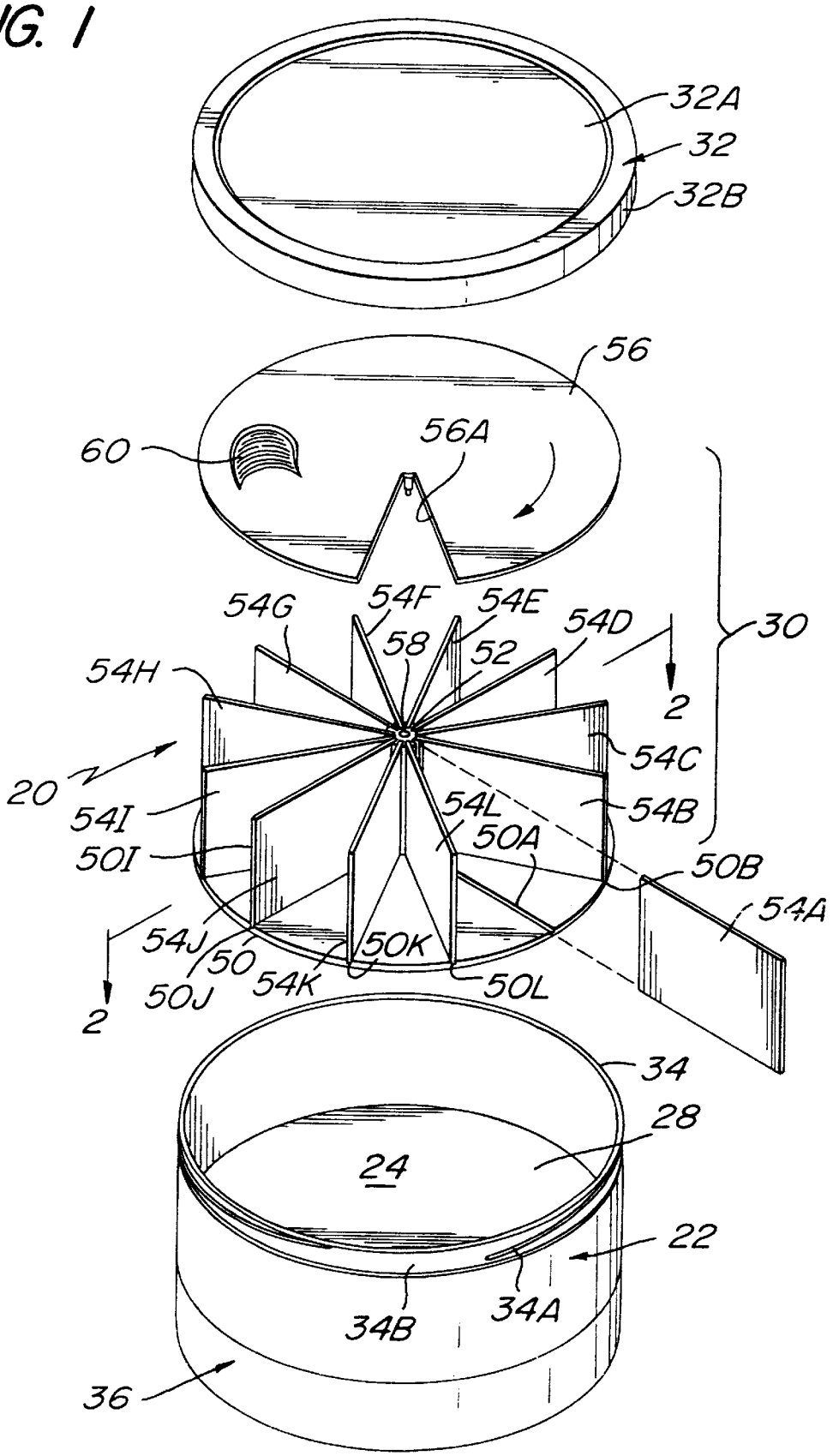
FIG. 1 is an exploded isometric view of one exemplary embodiment of a combination pill dispenser and collapsible drinking cup device constructed in accordance with this invention.
Figure 3:
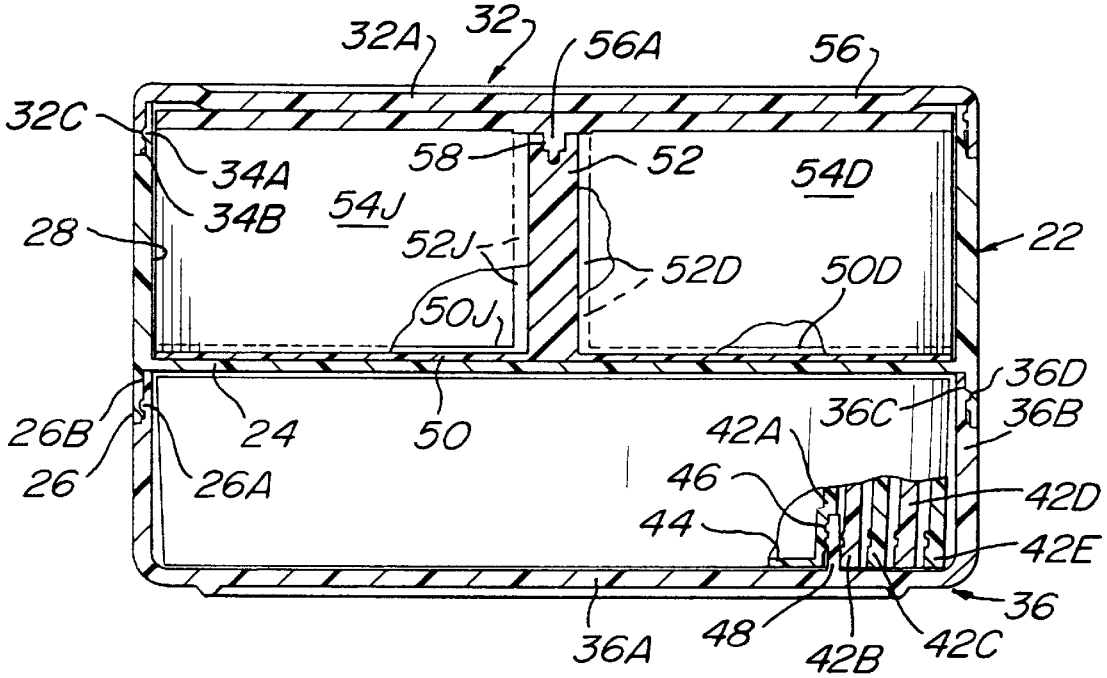
FIG. 3 is an enlarged sectional view taken along line 2—2 of FIG. 2.

Referring to Figs. there is shown at 20 a exemplary embodiment of a combination pill organizer and collapsible drinking cup unit constructed in accordance with this invention. The exemplary device 20 basically comprises a modification of the construction of a prior art jewelry cleaner device sold by Lockhart Jewelry Company, Inc. of Downingtown, Pa. under the trademark POWERVESCENT® jewelry cleaner. That device is best seen in FIG. 3 and basically includes a cylindrical tubular shell 22 having an end wall 24 located closely adjacent one end 26 of the shell to form a hollow chamber within the shell. In the prior art device the hollow chamber 28 is arranged to hold packets of POWERVESCENT® jewelry cleaner tablets and an instruction brochure. In the subject invention, the chamber 28 holds a pill organizer assembly 30 (to be described in detail later). The chamber 28 with the pill organizer assembly therein is arranged to be closed or covered by a removable cap 32 to hold the pill organizer in place therein. As best seen in FIGS. 1 and 3 the cap 32 includes a top generally planar wall portion 32A and a flanged sidewall or peripheral lip 32B. A helical thread receiving recess 32C extends about the inner periphery of the flanged sidewall 32B for releasable securement to a mating external thread 34A extending about an annular recess 34B in the end 34 of the shell 22 opposite the end wall 24.

Figure 4:
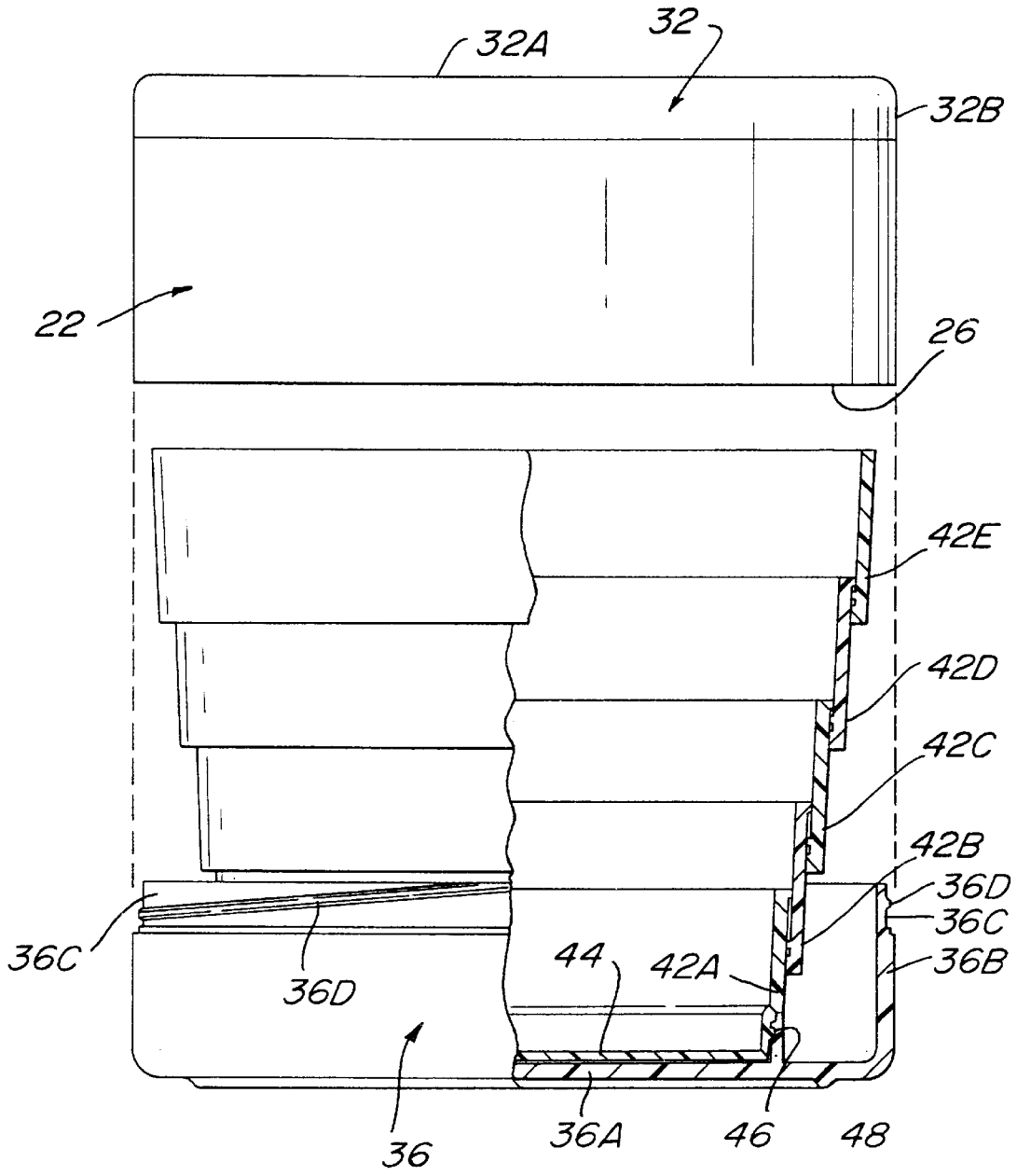
FIG. 4 is a side elevational view, partially in section, of the embodiment of the device of FIG. 1, showing the cup in its expanded condition.

A second removable cap 36 is provided for securement to the opposite end of the shell as the cap 34. The second cap 36 is best seen in FIGS. 1, 3 and 4. As can be seen therein the cap 36 also includes a planar end wall portion 36A having a peripheral flange or lip 36B upstanding therefrom. An annular recess 36C extends about the outer surface of the edge of the flange 36B. An external helical thread 36D extends about the outer surface of the recess 36C for releasable securement to a mating helical recess 26A extending about the inner periphery of the end portion 26 of the shell 22. The height of the sidewall or lip 36B of the cap 36 is substantially greater than the height of the sidewall or flange 32B of the cap 32 to form a relatively large hollow chamber 40 located between the inner surface of the end wall 36A of the cap 36 and the shell wall 24.

A collapsible cup 42 is mounted on the inside surface of the planar end wall 36A of the cap 36. The cup is of conventional construction. In particular, in the embodiment shown it is in the form of plural, e.g., five, nesting annular segments 42A, 42B, 42C, 42D, and 42E. Each segment is of a graduated diameter, e.g., a conical section, and is arranged to be slid from a nested position (to be described hereinafter) to an extended position (also to be described hereinafter) to form a leak-proof drinking cup 44.

As best seen in FIG. 3, the segment 42A is of the smallest diameter and is fixedly secured at its lower end to the inside surface of the end wall 36A of the cap 36. The section 42B is of slightly greater inside diameter than the section 42A so that it can be disposed thereabout in a "nested" position as shown in FIG. 3. In a similar manner the section 42C is of slightly greater inside diameter than the section 42B so that it can be disposed thereabout in the "nested" position. So too, the section 42D is of slightly greater inside diameter than the section 42C so that it can be disposed thereabout in a "nested" position. Lastly, the section 42E is of slightly greater inside diameter than the section 42D so that it can be disposed thereabout in a "nested" position.

The bottom of the drinking cup is in the form of an flanged insert 44 releasably secured by a helical thread 46 (FIG. 3) to a mating helical recess in an annular flange or wall 48 upstanding from the inner surface of the end wall 36A of the cap 36.

Each conical section 42A–42E forming the cup is arranged to be slid outward or away from its preceding section to extend the cup to its maximum size and to enable it to hold a liquid therein without leakage. In this regard, section 42B is arranged to be slid upward and away from its nested position around section 42A to its extended position thereabove, as shown in FIG. 4. In a similar manner section 42C is arranged to be slid away from its nested position around section 42B to its extended position. Similarly, section 42D is arranged to be slid away from its nested position around section 42C to its extended position. Lastly, section 42E is arranged to be slid away from its nested position around section 42D to its extended position.

A small outwardly projecting flange or lip 44 extends about the outer periphery of the top end of each of the segment 42A, 42B, 42C, 42D, and 42E. The inner periphery of the lower end of each of the segment 42B, 42C, 42D, and 42E also includes a small inwardly projecting flange or lip 46 extending thereabout. The flanges 44 and 46 are constructed and sized so that the section 42B cannot become disconnected from the section 42A, the section 42C cannot become disconnected from the section 42B, the section 42D cannot become disconnected from the section 42C, and the section 42D cannot become disconnected from the section 42E when the cup is in its fully extended position shown in FIG. 4.

As mentioned earlier the prior art POWERVESCENT® jewelry cleaner device is modified in accordance with this invention so that its internal chamber 28 which had been used for holding the jewelry cleaning tablets now holds the various components making up the pill organizer assembly 30. In accordance with one preferred aspect of this invention the organizer assembly 30 is a multichambered compartment for holding pills or other small items therein and with a rotatable cover thereover providing access to any selected one of the various compartments.

Figure 2:
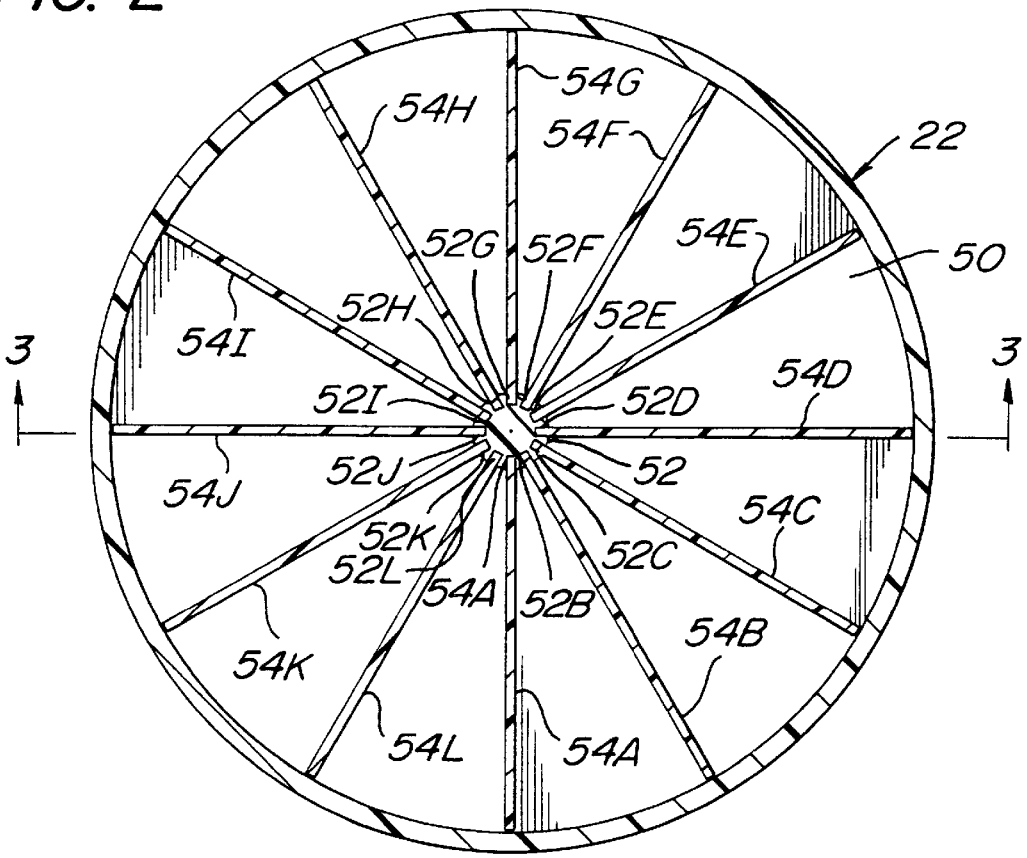
FIG. 2 is an enlarged sectional view taken along line 2—2 of FIG. 1.

Referring now to FIGS. 1–3 the details of the pill organizer assembly 30 will now be discussed. As can be seen that assembly basically comprises a base member 50, a post 52, a plurality, e.g., twelve, planar wall sections or panels 54A, 54B, 54C, 54D, 54E, 54F, 54G, 54H, 54I, 54J, 54K, and 54L, and a cover 56. The base member is a circular, planar disk whose outside diameter is just slightly less than the inside diameter of the shell 22. The post 52 is an elongated linear member which is located at the center of the base member 50 and extends upward perpendicularly therefrom. A plurality, e.g., twelve, elongated, longitudinally extending slots 52A, 52B, 52C, 52D, 52E, 52F, 52G, 52H, 52I, 52J, 52K, and 52L are located at equidistantly spaced positions around the periphery of the post 52. Each of the slots is arranged to receive an inside edge of an associated wall panel 54A, 54B, 54C, 54D, 54E, 54F, 54G, 54H, 54I, 54J, 54K, and 54L to mount the panels to the base member so that they extend radially outward from the post in a star-burst-like configuration. In order to further secure the panels 54A–54L in position, the base member includes twelve radially extending linear grooves, only 50A, 50B, 50D, 50I, 50J, 50K, and 50L can be seen. Each groove is of a width substantially equal to the thickness of the bottom edge of each of the wall sections so that it may tightly receive the lower edge of an associated wall section.

Since there are twelve wall panels or sections 54A–54L in the exemplary embodiment of the assembly 30, those wall sections form twelve wedge-shaped compartments between themselves, the cover 56 and the inner surface of the chamber 28, with each compartment extending for an arc of approximately 30 degrees about the periphery of the chamber 28.

The cover 56 is a circular, planar disk whose outside diameter is just slightly less than the inside diameter of the shell 22. A wedge shaped recess or opening 56A is located in the periphery of the cover 56 and extends to the center of the cover. The cover is arranged to be rotatably mounted on the post 50 over the top edge of the star-burst arrangement of wall panels 54A–54L. To that end a pin 56A extends perpendicularly downward from the center of the cover 56. The pin is arranged to be rotatably received within a mating bore 58 extending into the post 50 from the top end thereof.

The recess or opening 56A in the cover 56 is preferably of an arc of thirty degrees so that it can selectively completely expose each of the wedge shaped compartments formed by the walls 54A–54L when the cover is rotated to one of twelve positions wherein the wedge shape recess is disposed directly over a selected compartment.

In order to facilitate the rotation of the cover 56 to any desired position with respect to the compartments, the cover includes a dimpled or roughened portion 60 arranged to be readily engaged by a person's finger to rotate the cover the desired position.

Use of the unit 20 is as follows: if the user wishes to take some pill (not shown) held within any particular compartment of the pill organizer 30, all that is required is to remove the cap 32 from the unit, thereby exposing the cover 56 of the organizer 30 within the chamber 28. The user may then apply his/her finger to the dimpled or roughened portion 60 of the cover 56 to rotate the cover to a position wherein its opening 56A is directly over the selected compartment, i.e., the compartment holding the pill(s) to be taken. The unit 20 can then be inverted or tilted to enable the pill(s) to drop out of the now-open compartment into the user's hand. The cap 32 can then be replaced to seal the chamber 28 of the unit with the pill organizer assembly 30 therein.

If the person taking the dispensed pill(s) wishes to take it(them) with water or some other liquid, the other cap 36 of the unit 20 may be removed, e.g., unscrewed from the body, to expose the collapsed cup, i.e., the nested conical sections 42A–42E, in that cap. The uppermost and outermost of the sections, namely, section 42E, can then be grasped between the user's fingers to pull it and the associated conical sections from their normally nested configuration shown in FIG. 3 to their fully extended position shown in FIG. 4, thereby forming a leak-proof cup. The cup can then be filled with water or any liquid to enable the person to take the dispensed pill(s) with that liquid. After the pill(s) has/have been taken and the cup emptied, the cup can be readily collapsed by pressing on the uppermost section 45E to cause all the sections to nest within one another. Then the cap 36 with the collapsed conical cup sections can be screwed back into place on the unit's body to enclose the collapsed cup therein, whereupon the now-compact unit 20 may be conveniently stored away for future use.

As should be appreciated from the foregoing the device of the subject invention is of considerable utility since it enables persons to carry pills or other medicines and the like in respective compartments of an organizer, and to have available a drinking cup to facilitate the taking of those pills, all within a small, low-cost, easy-to-use unit.

Without further elaboration the foregoing will so fully illustrate my invention that others may, by applying current or future knowledge, adopt the same for use under various conditions of service.

I claim:

1. A combination pill dispenser and collapsible drinking cup device, said device comprising an elongated hollow body, a first removable cap member, a second removable cap member, a pill organizer, and a collapsible cup, said hollow body having an outer wall having opposed first and second ends and an end wall located adjacent said first end, said end wall and a portion of said hollow body contiguous with said second end forming a hollow chamber, said pill organizer being located within said chamber and comprising a plurality of compartments, said pill organizer including a cover having an opening therein which is arranged to selectively communicate with a respective one of said compartments, said first cap member being arranged for releasable securement to said hollow body to enclose said chamber, said second cap member having an end wall and a peripheral flange and being arranged for releasable securement to said first end of said hollow body, said collapsible cup being located on said end wall of said second cap member and within the bounds of said peripheral flange, said collapsible cup being arranged to be extended from a retracted position wherein it is located close to said end wall of said second cap member to an extended position wherein it is located further from said end wall of said second cap member.

2. The device of claim 1 wherein said collapsible cup comprises plural annular rings of decreasing diameter.

3. The device of claim 1 wherein said pill organizer comprises a plurality of releasably securable wall sections.

4. The device of claim 3 wherein said pill organizer comprises a central post to which said plurality of wall sections are releasably secured, and wherein said wall sections are oriented to radiate outward from said central post.

5. The device of claim 4 wherein said cover comprises a disk arranged be rotatably mounted on said post so that said opening therein may be disposed over a selected one of said compartments.

6. The device of claim 5 wherein said cover is rotatably mounted on said post by a pin.

7. The device of claim 6 wherein said pin is mounted on said cover and projects downward therefrom into an opening in said post.

8. The device of claim 5 wherein said pill organizer additionally comprises a base wall, said post projecting upward from the center of said base wall.

9. The device of claim 8 wherein said base wall includes plural grooves for holding said wall sections.

10. The device of claim 4 wherein said cover includes a portion arranged to be readily engaged by a person's finger to rotate said cover to a desired position whereupon said opening in said cover is disposed over a respective one of said compartments.

* * * * *